US012078382B2

(12) United States Patent
Yan

(10) Patent No.: US 12,078,382 B2
(45) Date of Patent: Sep. 3, 2024

(54) METHOD FOR ANTI-CONDENSATION AT AIR CONDITIONER RADIATION TERMINAL AND RADIATION TERMINALS IN MULTI-ROOM SPACE

(71) Applicant: NANJING HUIHE CONSTRUCTION TECHNOLOGY CO., LTD., Nanjing (CN)

(72) Inventor: Xu Yan, Nanjing (CN)

(73) Assignee: NANJING HUIHE CONSTRUCTION TECHNOLOGY CO., LTD., Nanjing (CN)

( * ) Notice: Subject to any disclaimer, the term of this patent is extended or adjusted under 35 U.S.C. 154(b) by 381 days.

(21) Appl. No.: 17/608,338

(22) PCT Filed: Apr. 14, 2021

(86) PCT No.: PCT/CN2021/087133
§ 371 (c)(1),
(2) Date: Nov. 2, 2021

(87) PCT Pub. No.: WO2022/068175
PCT Pub. Date: Apr. 7, 2022

(65) Prior Publication Data

US 2022/0341624 A1 Oct. 27, 2022

(30) Foreign Application Priority Data

Sep. 30, 2020 (CN) ..... 202011058970.9

(51) Int. Cl.
*F24F 13/22* (2006.01)
*F24F 3/14* (2006.01)
*F24F 3/153* (2006.01)
*F24F 5/00* (2006.01)

(52) U.S. Cl.
CPC ..... *F24F 13/22* (2013.01); *F24F 3/1405* (2013.01); *F24F 3/153* (2013.01); *F24F 5/0089* (2013.01); *F24F 2003/1452* (2013.01); *F24F 2013/221* (2013.01)

(58) Field of Classification Search
CPC ..... F24F 5/0089; F24F 5/0092
See application file for complete search history.

(56) References Cited

U.S. PATENT DOCUMENTS

2018/0156476 A1* 6/2018 McCarty ..... F24F 5/0092

FOREIGN PATENT DOCUMENTS

| | | | |
|---|---|---|---|
| CN | 202166137 | U | 3/2012 |
| CN | 104729149 | A | 6/2015 |
| CN | 206113121 | U | 4/2017 |
| CN | 206234930 | U | 6/2017 |
| CN | 108800355 | A | 11/2018 |

(Continued)

*Primary Examiner* — Jonathan Bradford

(57) ABSTRACT

A method for anti-condensation at an air conditioner radiation terminal includes transferring dehumidification heat in a fresh air ventilator to a refrigerant in a refrigerant tube via a plate heat exchanger in the fresh air ventilator to heat up the refrigerant and starting a pump in a cold and heat source. The pump drives the heat-exchanged and heated-up refrigerant to radiation terminals through the refrigerant tube, to implement anti-condensation. The dehumidification heat is heat that is absorbed when a heat exchanger performs refrigeration to dehumidify air.

10 Claims, 1 Drawing Sheet

(56) References Cited

FOREIGN PATENT DOCUMENTS

| | | | |
|---|---|---|---|
| CN | 209744650 | U | 12/2019 |
| CN | 112178778 | A | 1/2021 |
| JP | H08200882 | A | 8/1996 |

* cited by examiner

METHOD FOR ANTI-CONDENSATION AT AIR CONDITIONER RADIATION TERMINAL AND RADIATION TERMINALS IN MULTI-ROOM SPACE

CROSS REFERENCE TO RELATED APPLICATIONS

The present application claims the benefit of Chinese Patent Application No. 202011058970.9 filed on Sep. 30, 2020, the contents of which are hereby incorporated by reference.

TECHNICAL FIELD

The present invention relates to the field of air conditioning devices, and specifically, to a method for anti-condensation at an air conditioner radiation terminal and radiation terminals in a multi-room space.

BACKGROUND ART

With the continuous improvement of people's living standards and the continuous progress of science and technology, users has higher requirements on indoor environments. Conventional air conditioners with forced-convection heat transfer changes temperatures and humidity in a room through indoor air circulation and convection heat transfer, which is prone to cause uncomfortableness of indoor users. However, in the end of 80s of the 20th century, the German engineer Donald Herbst invented the capillary network plane radiation system which had received widespread attention. Decades after the invention, this type of stealth air conditioning system is applied to many high-end commercial buildings, government buildings, banks, public utilities, and healthcare constructions. As in nowadays, the capillary network radiation temperature control technology has been used with the fresh air technology. A capillary network provides sensible heat, and a fresh air processor set provides latent heat and fresh air required for air replacement. This type of air conditioning system, compared with conventional air conditioning, has obvious advantages of stable and safe operating, no wind blows, few noises, being comfortable and energy-saving, good indoor temperature uniformity, etc.

However, there are some drawbacks of the capillary network radiation fresh-air air conditioning system. In the process of using, when a surface temperature of an indoor capillary network is lower than an indoor air dew point, condensation can easily occur. If the problem of condensation is not well addressed, a wall surface may go moldy. At present, an air conditioning system often shuts off water to address the problem, and although this method can prevent deteriorating of condensation in a short time, there can still easily be condensation. In addition, especially in a transition season, an outdoor moisture load is heavy, but temperatures are lower, so that at this time both dehumidification and heating are needed indoors. A normal system running mode may make too cold inside a room and large energy consumptions; and existing fresh air systems also rely on working of an outdoor machine during dehumidification, which needs to consume a large amount of electrical power.

After research, a patent entitled "Radiating air conditioning system preventing moisture condensation through variable water temperatures" (published as CN202166137U) has been disclosed by Shanghai Landsea Building Tech. The air conditioning system disclosed in the patent comprises a radiation air conditioning system mounted indoors; a heat pump used for providing cold water or hot water to the radiation air conditioning system; and a fresh air feed system used for feeding fresh air into a room. The system also comprises a plurality of dehumidifiers mounted indoors and a central controller, a sensing device used for receiving indoor temperatures and humidity changes is arranged in the central controller, the central controller is connected to the heat pump for controlling temperatures of water output by the heat pump, moreover, the central controller is connected with the dehumidifiers for controlling start and stop of the dehumidifiers. In the patent, the dehumidifiers are controlled by the central controller to start and close for dehumidifying, meanwhile, the temperatures of water output by the heat pump is improved, so that moisture condensation can not be formed. However, in a case in which a window is opened suddenly, after the heat pump changes the water temperatures, not only a water temperature increasing rate is relatively slow, but electrical energy is greatly consumed, so that more effective anti-condensation is difficult to be achieved.

SUMMARY

1. Technical Problem to be Solved in the Patent

An objective of the present invention is to provide an air conditioning system for anti-condensation at a radiation terminal, to overcome a technical problem in the conventional technology that condensation is easily to occur at a radiation terminal and there is high energy consumption in anti-condensation. By using heat of condensation in dehumidification in a fresh air ventilator, the heat of condensation in the dehumidification is utilized to increase a wall temperature, to prevent condensation.

2. Technical Solutions

To achieve the foregoing objective, the present invention provides following technical solutions:

According to a method for anti-condensation at an air conditioner radiation terminal, when a dehumidifying heat exchanger in a fresh air ventilator performs refrigeration to dehumidify, dehumidification heat in the fresh air ventilator is transferred to a refrigerant in a refrigerant tube via a plate heat exchanger in the fresh air ventilator and the refrigerant heats up; and a pump in a cold and heat source is started, where the pump drives the heat-exchanged and heated-up refrigerant to radiation terminals through the refrigerant tube, to implement anti-condensation.

Preferably, a system used in the method comprises the cold and heat source, the fresh air ventilator, and the radiation terminals, the fresh air ventilator comprises a plate heat exchanger, a fresh air tube, and a compressor, a heat exchanger is disposed in the fresh air tube, the heat exchanger, one end of the plate heat exchanger, and the compressor are connected via tubes to form a refrigerant circuit, and flow restrictors are disposed on the tubes; the other end of the plate heat exchanger, the cold and heat source, and the radiation terminals are connected via tubes to form a refrigerant circuit, and a balance valve is disposed on the tubes; heat can be exchanged between the one end of the plate heat exchanger and the other end of the plate heat exchanger; and the fresh air ventilator is further disposed with a humidifier, where the humidifier is connected to a water source via a fresh air water replenishing tube.

Preferably, the cold and heat source comprises the pump, a water outlet of the pump is connected to a first water main, branches at the other end of the first water main are a second water main and a fresh air water main, the second water main is connected to water inlets of the radiation terminals, and the fresh air water main is connected to a water inlet at the other end of the plate heat exchanger; and a water inlet of the pump is connected to a first return main, branches at the other end of the first return main are a second return main and a fresh air return main, the second return main is connected to water outlets of the radiation terminals, and the fresh air return main is connected to a water outlet at the other end of the plate heat exchanger.

Preferably, the heat exchanger in the fresh air tube includes an evaporator and a reheating heat exchanger, a fresh air heat exchange flow restrictor is disposed at a first plate-type heat exchange port at the one end of the plate heat exchanger, and the first plate-type heat exchange port is connected to a first runner tube of a fresh air evaporator and a first reheating runner tube; the first runner tube is connected to a refrigerant flow port of the evaporator, and another refrigerant flow port of the evaporator is connected to a second plate-type heat exchange port via the compressor; the first reheating runner tube is connected to a refrigerant flow port of the reheating heat exchanger, a reheating flow restrictor is disposed on the first runner tube, and another refrigerant flow port of the reheating heat exchanger is connected to the second plate-type heat exchange port.

Preferably, the heat exchanger in the fresh air tube further includes a precooling heat exchanger, a water inlet of the precooling heat exchanger is connected to the fresh air water main via a tube, and a precooling water supply regulator is disposed on the tube between the water inlet and the fresh air water main; a water outlet of the precooling heat exchanger is connected to the fresh air return main via a tube; and/or a fresh air water supply dynamic balance valve is disposed on the fresh air water main.

Preferably, the fresh air return main is connected to a plate-type exchange return branch, and the plate-type exchange return branch is connected to a heat exchange port at the one end of the plate heat exchanger; and the fresh air water main is connected to a plate-type exchange water branch, the plate-type exchange water branch is connected to another heat exchange port at the one end of the plate heat exchanger, and a plate-type exchange water supply regulator is disposed on the plate-type exchange water branch.

Preferably, the cold and heat source includes the pump, a water outlet of the pump is connected to a first water main, and a water inlet of the pump is connected to a first return main; there are a plurality of radiation terminals, the first water main is connected to one end of a second water main, there are a plurality of water branches at the other end of the second water main, and each water branch is separately connected to a water inlet of one radiation terminal; and the first return main is connected to one end of a second return main, there are a plurality of return branches at the other end of the second return main, and each return branch is separately connected to a water outlet of one radiation terminal.

Preferably, the first return main is connected to the fresh air water replenishing tube via a radiation water replenishing tube, and a fresh air water replenishing valve is disposed on the radiation water replenishing tube; and/or the fresh air water replenishing valve is disposed on the fresh air water replenishing tube; and/or a water replenishing pressure relief valve, a water replenishing constant pressure difference valve, and/or a water replenishing filter are/is disposed on the fresh air water replenishing tube near a water source.

Preferably, a water main valve, a water main check valve, and/or a water main vent valve are/is disposed on the first water main; and/or a return main valve, a return main check valve, and/or a return main vent valve are/is disposed on the first return main;

a fresh air water supply valve and/or a fresh air water supply filter are/is disposed on the fresh air water main; and/or a fresh air return valve is disposed on the fresh air return main; and/or manifolds are disposed at the water inlets and the water outlets of the radiation terminals, manifold outlet valves are disposed on the return branches, and/or manifold inlet valves and/or radiation water source filters are disposed on the water branches.

The present invention provides a method for anti-condensation at radiation terminals of an air conditioning system in a multi-room space, and steps are as follows:

Step (1): An anti-condensation measuring device measures, in each room space, to obtain a dew point temperature to, and a wall temperature measuring device measures to obtain a wall temperature t, where when $t-t0 \leq t1$, a status of condensation in the room space is denoted as a state A; and then a master timer starts to keep a time T and gives an alarm;

Step (2): whether $t \geq t2$ is determined, where when $t \geq t2$, the status of condensation in the room space is denoted as a state B, and a terminal in the room is turned off; or when $t < t2$, an anti-condensation process is performed in all rooms in the state A, and the anti-condensation process is the foregoing method for anti-condensation at a radiation terminal of an air conditioning system;

Step (3): whether $T > T1$ is determined, where when the time $T > T1$, anti-condensation is ended in all rooms, and a room that is not alarmed recovers to a state before the alarm; and after a time T2, a cold and heat source returns to a working mode before the alarm, and step (6) is performed next; or when the time $T \leq T1$, step (4) is performed next;

Step (4): whether $t \geq t3$ is determined, where when $t \geq t3$, the status of condensation in the room space is denoted as the state B, and the terminal in the room is turned off; or when $t < t3$, step (3) is performed next;

Step (5): whether states of all alarmed rooms are B is determined, where when all the states are B, anti-condensation is ended in all the rooms, and the room that is not alarmed recovers to the state before the alarm; and after the time T2, a heat pump returns to a working mode before the alarm; or when not all the states are B, step (2) is performed next; and Step (6): whether $t-t0 \geq t4$ and whether the dew point temperature t0 is less than $t6-t5$ are determined, where t6 is a configured water temperature of the heat pump, where when $t-t0 \geq t4$ and $t0 \leq t6-t5$, the time T kept by the timer is cleared, and the status of condensation in the room space is denoted as an anti-condensation alarm cancel state.

In another case, a current state of operating is maintained.

3. Beneficial Effects

Comparing the technical solutions provided in the present invention with existing well-known technologies, obvious effects are as follows:

(1) According to the method for anti-condensation at an air conditioner radiation terminal in the present invention, when a dehumidifying heat exchanger in a fresh air ventilator performs refrigeration to dehumidify, dehumidification heat in the fresh air ventilator is transferred to a refrigerant in a refrigerant tube via a plate heat exchanger in the fresh air ventilator and the refrigerant heats up; a pump in a cold and heat source is started, where the pump drives the heat-exchanged and heated-up refrigerant to radiation terminals through the refrigerant tube, to implement anti-condensation; and heat of condensation generated in the dehumidification in the fresh air ventilator is used for providing a heat source for the indoor radiation terminals, thereby preventing condensation, reducing consumption of electric energy, and preventing condensation quickly.

(2) According to the method for anti-condensation, based on the foregoing method for anti-condensation, at radiation terminals of an air conditioning system in a multi-room space in the present invention, a dew point temperature t0 and a wall temperature t that is measured by a wall temperature measuring device that are in each room space are measured and obtained, to calculate a temperature difference and control a parameter such as a kept time, and heat of condensation in dehumidification in a fresh air ventilator is effectively used, to prevent condensation indoors, especially in a plurality of rooms, and gain a good effect of saving energy.

Figure 1:
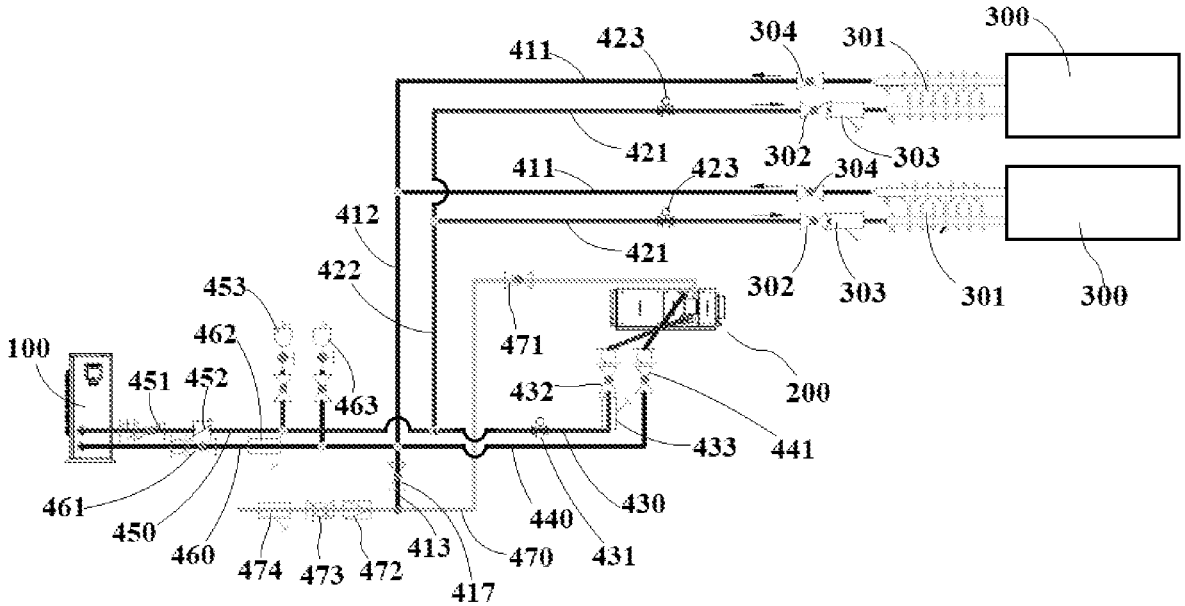
FIG. 1 is schematic diagram of an overall structure of a system used for a method for anti-condensation at an air conditioner radiation terminal.

100: cold and heat source;

200: fresh air ventilator; 210: fresh air tube; 211: precooling heat exchanger; 212: evaporator; 213: reheating heat exchanger; 214: humidifier; 220: compressor; and 230: plate heat exchanger;

300: radiation terminal; 301: manifold; 302: manifold inlet valve; 303: radiation water source filter; and 304: manifold outlet valve;

411: return branch; 412: second return main; 460: first return main; 461: return main valve; 462: return main filter; and 463: return main vent valve;

440: fresh air return main; 441: fresh air return valve; 442: precooling return branch; and 443: plate-type exchange return branch;

450: first water main; 451: water main valve; 452: water main check valve; 453: water main vent valve; 422: second water main; 421: water branch; and 423: radiation water supply dynamic balance valve;

430: fresh air water main; 431: fresh air water supply dynamic balance valve; 432: fresh air water supply valve; 433: fresh air water supply filter; 434: precooling water branch; 435: precooling water supply regulator; 436: plate-type exchange water branch; and 437: plate-type exchange water supply regulator;

413: radiation water replenishing tube; 417: radiation water replenishing valve; 470: fresh air water replenishing tube; 471: fresh air water replenishing valve; 472: water replenishing pressure relief valve; 473: water replenishing constant pressure difference valve; and 474: water replenishing filter; and

481: first plate-type heat exchange port; 482: second plate-type heat exchange port; 483: fresh air heat exchange flow restrictor; 484: first runner tube of a fresh air evaporator; 491: second runner tube of a fresh air evaporator; 485: first reheating runner tube; 486: reheating flow restrictor; and 492: second reheating runner tube.

DETAILED DESCRIPTION OF THE EMBODIMENTS

To further understand content in the present invention, the present invention is described in detail with reference to the accompanying drawings and embodiments.

Structures, proportions, sizes, etc. illustrated in the accompanying drawings of the present invention are only used for describing content disclosed in this specification, to let a person skilled in the art read and understand, but not to limit restriction conditions implementable in the present invention, and therefore do not carry essential meanings technically. Any modification of the structures, any change of the proportions, and any adjustment of the sizes, without affecting effects and objectives of the present invention, all shall fall within the scope covered by technical content disclosed in the present invention. In addition, terms used in this specification such as "top/upper", "down/lower", "left", "right", "middle/central", etc. are merely for providing clear descriptions, but not for limiting the implementation scope. Changes or adjustments of the relative relationships, without changing essential technical content, shall fall within the implementation scope of the present invention. Besides, various embodiments of the present invention are not independent from each other but could be combined together.

According to a method for anti-condensation at a radiation terminal of an air conditioning system in an embodiment, when a dehumidifying heat exchanger in a fresh air ventilator 200 performs refrigeration to dehumidify, dehumidification heat in the fresh air ventilator 200 is transferred to a refrigerant in a refrigerant tube via a plate heat exchanger 230 in the fresh air ventilator 200 and the refrigerant heats up; and a pump in a cold and heat source 100 is started, wherein the pump drives the heat-exchanged and heated-up refrigerant to radiation terminals 300 through the refrigerant tube, to implement anti-condensation.

In addition, according to a method for anti-condensation at radiation terminals of an air conditioning system in a multi-room space in this embodiment, and specific steps of anti-condensation are as follows:

Step (1): An anti-condensation measuring device measures, in each room space, to obtain a dew point temperature t0, and a wall temperature measuring device measures to obtain a wall temperature t, where when $t-t0 \leq t1$, a status of condensation in the room space is denoted as a state A; and then a master timer starts to keep a time T and gives an alarm;

Step (2): whether $t \geq t2$ is determined, where when $t \geq t2$, the status of condensation in the room space is denoted as a state B, and a terminal in the room is turned off; or when $t < t2$, an anti-condensation process is performed in all rooms in the state A, and the anti-condensation process is the method for anti-condensation at a radiation terminal of an air conditioning system in this embodiment;

Step (3): whether $T > T1$ is determined, where when the time $T > T1$, anti-condensation is ended in all rooms, and a room that is not alarmed recovers to a state before the alarm; and after a time T2, a cold and heat source returns to a working mode before the alarm, and step (6) is performed next; or when the time T≤T1, step (4) is performed next;

Step (4): whether t≥t3 is determined, where when t≥t3, the status of condensation in the room space is denoted as the state B, and the terminal in the room is turned off; or when t<t3, step (3) is performed next;

Step (5): whether states of all alarmed rooms are B is determined, where when all the states are B, anti-condensation is ended in all the rooms, and the room that is not alarmed recovers to the state before the alarm; and after the time T2, a heat pump returns to a working mode before the alarm; or when not all the states are B, step (2) is performed next; and Step (6): whether t−t0≥t4 and whether the dew point temperature t0 is less than t6−t5 are determined, where t6 is a configured water temperature of the heat pump, where when t−t0≥t4 and t0≤t6−t5, the time T kept by the timer is cleared, and the status of condensation in the room space is denoted as an anti-condensation alarm cancel state; or in another case, a current state of operating is maintained.

In this embodiment, t1 is 2° C., t2 is 22° C., t3 is 24° C., t4 is 3° C., t5 is 1° C., t6 is the configured water temperature of the heat pump, and 12° C.≤t6≤20° C.; and T1 is 30 min, and T2 is 5 min. By using the foregoing method for anti-condensation, heat of condensation in dehumidification in the fresh air ventilator 200 is effectively used, to prevent condensation indoors, especially in a plurality of rooms, gain a good effect of saving energy, and prevent condensation quickly.

It should be noted that the dew point temperature in the foregoing process is calculated based on parameters of a temperature and a humidity by using the Magnus formula and other formulas, and other automatic control is implemented by using a single-chip microcomputer, a processor, and other conventional automatic control software or hardware.

Figure 2:
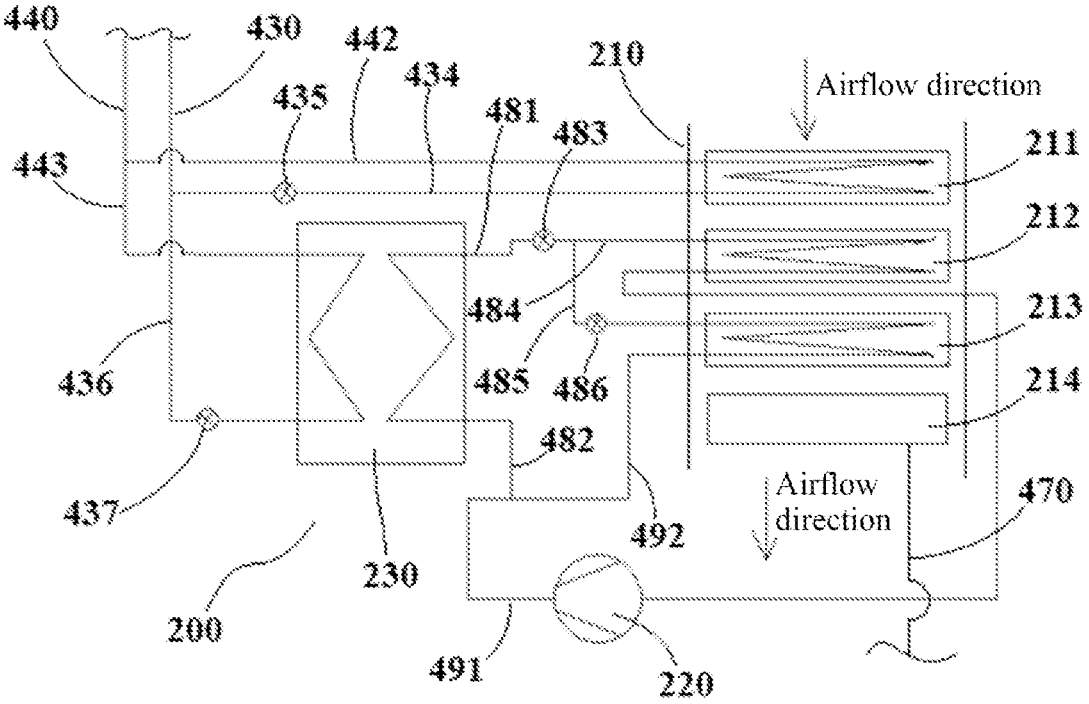
FIG. 2 is schematic structural diagram of a fresh air ventilator in a system used for a method for anti-condensation at an air conditioner radiation terminal.

As shown in FIG. 1 and FIG. 2, an air conditioning system used in the foregoing method for anti-condensation at a radiation terminal includes a cold and heat source 100, a fresh air ventilator 200, and radiation terminals 300, where the cold and heat source 100 comprises a pump. A heat release end of a condenser in dehumidification of the fresh air ventilator 200, the pump in the system, and the radiation terminals 300 form a refrigerant circuit via tubes, where the refrigerant circuit transfers heat at the heat release end of the condenser in the dehumidification to the radiation terminals 300 by using a refrigerant in the refrigerant circuit.

More specifically, the fresh air ventilator 200 comprises a plate heat exchanger 230, a fresh air tube 210, and a compressor 220, a dehumidifying heat exchanger is disposed in the fresh air tube 210, the dehumidifying heat exchanger, one end of the plate heat exchanger 230, and the compressor 220 are connected via tubes to form a refrigerant circuit, and flow restrictors are disposed on the tubes; the other end of the plate heat exchanger 230, the cold and heat source 100, and the radiation terminals 300 are connected via tubes to form a refrigerant circuit, and a balance valve is disposed on the tubes; heat can be exchanged between the one end of the plate heat exchanger 230 and the other end of the plate heat exchanger 230, and the condenser in the dehumidification of the fresh air ventilator 200 is the dehumidifying heat exchanger disposed in the fresh air tube 210. In this embodiment, the heat exchanger in the fresh air tube 210 comprises an evaporator 212 and a reheating heat exchanger 213, where the evaporator 212 may be used as a dehumidifying heat exchanger; and the evaporator 212, the one end of the plate heat exchanger 230, and the compressor 220 are connected via tubes to form a refrigerant circuit, so that the evaporator 212 may reduce temperatures and dehumidify, and heat can be exchanged between the one end of the plate heat exchanger 230 and the other end of the plate heat exchanger 230.

The other end of the plate heat exchanger 230, the cold and heat source 100, and the radiation terminals 300 are connected via tubes to form the refrigerant circuit, and the balance valve is disposed on the tubes, to maintain stable operating of the refrigerant in the circuit. Heat can be exchanged between the one end of the plate heat exchanger 230 and the other end of the plate heat exchanger 230. In the dehumidification of the fresh air ventilator 200, heat of condensation at the one end of the plate heat exchanger 230 is transferred to the other end of the plate heat exchanger 230 by using the plate heat exchanger 230, and the other end of the plate heat exchanger 230, the cold and heat source 100, and the radiation terminals 300 are connected via tubes to form the refrigerant circuit, to transfer the heat of condensation into the radiation terminals 300, to prevent condensation at the radiation terminals 300, and fully effectively utilize the heat of condensation in the dehumidification of the fresh air ventilator 200, thereby greatly improving energy utilization and reducing device operating loads with reduced energy consumption.

Specifically, the cold and heat source 100 comprises the pump, a water outlet of the pump is connected to a first water main 450, branches at the other end of the first water main 450 are a second water main 422 and a fresh air water main 430, the second water main 422 is connected to water inlets of the radiation terminals 300, and the fresh air water main 430 is connected to a water inlet at the other end of the plate heat exchanger 230; and a water inlet of the pump is connected to a first return main 460, branches at the other end of the first return main 460 are a second return main 412 and a fresh air return main 440, the second return main 412 is connected to water outlets of the radiation terminals 300, and the fresh air return main 440 is connected to a water outlet at the other end of the plate heat exchanger 230; a refrigerant circuit is formed; a water main valve 451, a water main check valve 452, and/or a water main vent valve 453 are/is disposed on the first water main 450; and/or a return main valve 461, a return main check valve 462, and/or a return main vent valve 463 are/is disposed on the first return main 460; a fresh air water supply valve 432 and/or a fresh air water supply filter 433 are/is disposed on the fresh air water main 430; and/or a fresh air return valve 441 is disposed on the fresh air return main 440.

In the fresh air ventilator 200, the heat exchanger in the fresh air tube 210 comprises an evaporator 212 and a reheating heat exchanger 213, a fresh air heat exchange flow restrictor 483 is disposed at a first plate-type heat exchange port 481 at the one end of the plate heat exchanger 230, and the first plate-type heat exchange port 481 is connected to a first runner tube 484 and a first reheating runner tube 485 that are of a fresh air evaporator; the first runner tube 484 is connected to a refrigerant flow port of the evaporator 212, and another refrigerant flow port of the evaporator 212 is connected to a second plate-type heat exchange port 482 via the compressor 220; the first reheating runner tube 485 is connected to a refrigerant flow port of the reheating heat exchanger 213, a reheating flow restrictor 486 is disposed on the first runner tube 485, and another refrigerant flow port of the reheating heat exchanger 213 is connected to the second plate-type heat exchange port 482. In this embodiment, the fresh air return main 440 is connected to a plate-type exchange return branch 443, and the plate-type exchange return branch 443 is connected to a heat exchange port at the one end of the plate heat exchanger 230; and the fresh air water main 430 is connected to a plate-type exchange water branch 436, the plate-type exchange water branch 436 is connected to another heat exchange port at the one end of the plate heat exchanger 230, and a plate-type exchange water supply regulator 437 is disposed on the plate-type exchange water branch 436.

The foregoing structure can satisfy requirements on cooling down, heating up, or dehumidifying fresh air in the fresh air ventilator 200. In addition, the fresh air ventilator 200 is further disposed with a humidifier 214, where the humidifier 214 is connected to a water source via a fresh air water replenishing tube 470, and the humidifier 214 can satisfy a requirement on humidifying fresh air.

In addition, the heat exchanger in the fresh air tube 210 further comprises a precooling heat exchanger 211, a water inlet of the precooling heat exchanger 211 is connected to the fresh air water main 430 via a tube, and a precooling water supply regulator 435 is disposed on the tube between the water inlet and the fresh air water main 430; a water outlet of the precooling heat exchanger 211 is connected to the fresh air return main 440 via a tube; and/or a fresh air water supply dynamic balance valve 431 is disposed on the fresh air water main 430.

For the radiation terminals 300, a water outlet of the pump of the cold and heat source 100 is connected to a first water main 450, and a water inlet of the pump is connected to a first return main 460; there are a plurality of radiation terminals 300, the first water main 450 is connected to one end of a second water main 422, there are a plurality of water branches 421 at the other end of the second water main 422, and each water branch 421 is separately connected to a water inlet of one radiation terminal 300; and the first return main 460 is connected to one end of a second return main 412, there are a plurality of return branches 411 at the other end of the second return main 412, and each return branch 411 is separately connected to a water outlet of one radiation terminal 300. Radiation water supply dynamic balance valves 423 are disposed on the water branches 421; and manifolds 301 are disposed at the water inlets and the water outlets of the radiation terminals 300, and/or manifold outlet valves 304 are disposed on the return branches 411, and/or manifold inlet valves 302 and/or radiation water source filters 303 are disposed on the water branches 421.

It should further be noted that, the first return main 460 is connected to the fresh air water replenishing tube 470 via a radiation water replenishing tube 413, and a fresh air water replenishing valve 471 is disposed on the radiation water replenishing tube 413. In the refrigerant circuit, if there is a lack of water, the refrigerant circuit can be replenished with water by using the water source.

The foregoing describes the present invention in detail with reference to specific example embodiments. However, it should be understood that, there can be various modifications and verifications without departing from the scope the present invention restricted by the claims. The detailed descriptions and the accompanying drawings are considered as illustrative but not limitative. Any such modification and verification shall fall within the scope of the present invention described herein. In addition, the background is intended to describe the status-quo and significance of the prior art, but not to limit the present invention or this application or a field to which the present invention is applied.

More specifically, although the example embodiments of the present invention are described, the present invention is not limited to the embodiments, but includes any embodiment or all embodiments with modifications or omissions such as a combination or an adjustable change and/or replacement of various embodiments understood by a person skilled in the art based on the foregoing detailed descriptions. Restrictions in the claims may be explained extensively based on words used in the claims, and is not limited to examples in the foregoing detailed descriptions or examples described during implementing this application. These examples should be considered non-exclusive. Any step enlisted in any method or process claim may be performed in any sequence, and is not limited to the sequence provided in the claims. Therefore, the scope of the present invention shall be determined based on the claims and lawful equivalents of the claims, but not determined based on the foregoing descriptions or examples.

What is claimed is:

1. A method for anti-condensation at an air conditioner radiation terminal, the method comprising:

transferring dehumidification heat in a fresh air ventilator to a refrigerant in a refrigerant tube via a plate heat exchanger in the fresh air ventilator to heat up the refrigerant; and starting a pump in a cold and heat source, wherein the pump drives the heat-exchanged and heated-up refrigerant to radiation terminals through the refrigerant tube, to implement anti-condensation, and wherein the dehumidification heat is heat that is absorbed when a heat exchanger performs refrigeration to dehumidify air.

2. The method for anti-condensation at an air conditioner radiation terminal according to claim 1, wherein a system used in the method comprises the cold and heat source, the fresh air ventilator, and the radiation terminals, the fresh air ventilator comprises a plate heat exchanger, a fresh air tube, and a compressor, the heat exchanger is disposed in the fresh air tube, the heat exchanger, one end of the plate heat exchanger, and the compressor are connected via tubes to form a refrigerant circuit, and flow restrictors are disposed on the tubes; the other end of the plate heat exchanger, the cold and heat source, and the radiation terminals are connected via tubes to form a refrigerant circuit, and a balance valve is disposed on the tubes; heat can be exchanged between the one end of the plate heat exchanger and the other end of the plate heat exchanger; and the fresh air ventilator is further disposed with a humidifier, wherein the humidifier is connected to a water source via a fresh air water replenishing tube.

3. The method for anti-condensation at an air conditioner radiation terminal according to claim 2, wherein the cold and heat source comprises the pump, a water outlet of the pump is connected to a first water main, branches at the other end of the first water main are a second water main and a fresh air water main, the second water main is connected to water inlets of the radiation terminals, and the fresh air water main is connected to a water inlet at the other end of the plate heat exchanger; and a water inlet of the pump is connected to a first return main, branches at the other end of the first return main are a second return main and a fresh air return main, the second return main is connected to water outlets of the radiation terminals, and the fresh air return main is connected to a water outlet at the other end of the plate heat exchanger.

4. The method for anti-condensation at an air conditioner radiation terminal according to claim 2, wherein the heat exchanger in the fresh air tub comprises an evaporator and a reheating heat exchanger, a fresh air heat exchange flow restrictor is disposed at a first plate-type heat exchange port at the one end of the plate heat exchanger, and the first plate-type heat exchange port is connected to a first runner tube and a first reheating runner tube that are of a fresh air evaporator; the first runner tube is connected to a refrigerant flow port of the evaporator, and another refrigerant flow port of the evaporator is connected to a second plate-type heat exchange port via the compressor; the first reheating runner tube is connected to a refrigerant flow port of the reheating heat exchanger, a reheating flow restrictor is disposed on the first runner tube, and another refrigerant flow port of the reheating heat exchanger is connected to the second plate-type heat exchange port.

5. The method for anti-condensation at an air conditioner radiation terminal according to claim 3, wherein the heat exchanger in the fresh air tube further comprises a precooling heat exchanger, a water inlet of the precooling heat exchanger is connected to the fresh air water main via a tube, and a precooling water supply regulator is disposed on the tube between the water inlet and the fresh air water main; a water outlet of the precooling heat exchanger is connected to the fresh air return main via a tube; and/or a fresh air water supply dynamic balance valve is disposed on the fresh air water main.

6. The method for anti-condensation at an air conditioner radiation terminal according to claim 3, wherein the fresh air return main is connected to a plate-type exchange return branch, and the plate-type exchange return branch is connected to a heat exchange port at the one end of the plate heat exchanger; and the fresh air water main is connected to a plate-type exchange water branch, the plate-type exchange water branch is connected to another heat exchange port at the one end of the plate heat exchanger, and a plate-type exchange water supply regulator is disposed on the plate-type exchange water branch.

7. The method for anti-condensation at an air conditioner radiation terminal according to claim 2, wherein the cold and heat source comprises the pump, a water outlet of the pump is connected to a first water main, and a water inlet of the pump is connected to a first return main; there are a plurality of radiation terminals, the first water main is connected to one end of a second water main, there are a plurality of water branches at the other end of the second water main, and each water branch is separately connected to a water inlet of one radiation terminal; and the first return main is connected to one end of a second return main, there are a plurality of return branches at the other end of the second return main, and each return branch is separately connected to a water outlet of one radiation terminal.

8. The method for anti-condensation at an air conditioner radiation terminal according to claim 2, wherein the first return main is connected to the fresh air water replenishing tube via a radiation water replenishing tube, and a fresh air water replenishing valve is disposed on the radiation water replenishing tube; and/or the fresh air water replenishing valve is disposed on the fresh air water replenishing tube; and/or a water replenishing pressure relief valve, a water replenishing constant pressure difference valve, and/or a water replenishing filter are/is disposed on the fresh air water replenishing tube near a water source.

9. The method for anti-condensation at an air conditioner radiation terminal according to claim 1, wherein a water main valve, a water main check valve, and/or a water main vent valve are/is disposed on a first water main; and/or a return main valve, a return main check valve, and/or a return main vent valve are/is disposed on a first return main;

a fresh air water supply valve and/or a fresh air water supply filter are/is disposed on a fresh air water main; and/or a fresh air return valve is disposed on a fresh air return main; and/or manifolds are disposed at the water inlets and the water outlets of the radiation terminals, and/or manifold outlet valves are disposed on the return branches, and/or manifold inlet valves and/or radiation water source filters are disposed on the water branches.

10. The method for anti-condensation at an air conditioner radiation terminal according to claim 2, wherein a water main valve, a water main check valve, and/or a water main vent valve are/is disposed on a first water main; and/or a return main valve, a return main check valve, and/or a return main vent valve are/is disposed on a first return main;

a fresh air water supply valve and/or a fresh air water supply filter are/is disposed on a fresh air water main; and/or a fresh air return valve is disposed on a fresh air return main; and/or manifolds are disposed at the water inlets and the water outlets of the radiation terminals, and/or manifold outlet valves are disposed on the return branches, and/or manifold inlet valves and/or radiation water source filters are disposed on the water branches.

* * * * *